US009776100B2

(12) United States Patent
Wong et al.

(10) Patent No.: US 9,776,100 B2
(45) Date of Patent: Oct. 3, 2017

(54) AIR DELIVERED SPECIAL EFFECTS

(71) Applicant: Disney Enterprises, Inc., Burbank, CA (US)

(72) Inventors: Clifford Wong, Burbank, CA (US); John Bouman, Chino Hills, CA (US); Kevin Kelley, Fullerton, CA (US); Ken Wagner, Garden Grove, CA (US)

(73) Assignee: Disney Enterprises, Inc., Burbank, CA (US)

( * ) Notice: Subject to any disclaimer, the term of this patent is extended or adjusted under 35 U.S.C. 154(b) by 91 days.

(21) Appl. No.: 14/535,281

(22) Filed: Nov. 6, 2014

(65) Prior Publication Data

US 2016/0129363 A1 May 12, 2016

(51) Int. Cl.

*A63H 33/22* (2006.01)
*A63H 37/00* (2006.01)
*A63H 27/00* (2006.01)

(52) U.S. Cl.

CPC ..... *A63H 37/00* (2013.01); *A63H 27/00* (2013.01); *A63H 27/12* (2013.01)

(58) Field of Classification Search

CPC ..... A63H 27/02; A63H 27/12; A63H 30/04; B64D 1/00; B64D 1/02; B64D 1/16; B64C 39/024; B64C 2201/12; B64C 2201/021; B64C 2201/024; B64C 2201/128; B64C 2201/146

See application file for complete search history.

(56) References Cited

U.S. PATENT DOCUMENTS

| | | | | |
|---|---|---|---|---|
| 7,780,498 | B1 * | 8/2010 | Caspi | A63H 27/004 446/454 |
| 7,806,371 | B2 * | 10/2010 | Troutman | A63H 27/004 244/190 |
| 8,190,305 | B1 | 5/2012 | Prince | |
| 8,702,033 | B2 | 4/2014 | Regmi | |
| 2005/0127242 | A1 * | 6/2005 | Rivers, Jr. | B64C 39/024 244/137.1 |

(Continued)

FOREIGN PATENT DOCUMENTS

| | | | |
|---|---|---|---|
| CN | 103212211 | | 7/2013 |
| CN | 203575471 U | * | 5/2014 |

(Continued)

OTHER PUBLICATIONS

Machine Translation into English of CN 203575471 U May 2014, Li, Hailong, Huang, Minjie.*

*Primary Examiner* — Aarti B Berdichevsky
*Assistant Examiner* — Urszula M Cegielnik
(74) *Attorney, Agent, or Firm* — Patent Ingenuity, P.C.; Samuel K. Simpson

(57) ABSTRACT

A discharge platform comprises an air propulsion mechanism that propels the discharge platform through the air. The discharge platform also comprises a special effect storage device that stores a special effect and is operably connected to the discharge platform. Further, the discharge platform comprises a processor. In addition, the discharge platform comprises an air delivery special effect mechanism that discharges a special effect from the special effect storage device toward a destination after receiving an instruction from the processor and during propulsion of the discharge platform through the air by the air propulsion mechanism.

13 Claims, 3 Drawing Sheets

(56) References Cited

U.S. PATENT DOCUMENTS

| | | | | |
|---|---|---|---|---|
| 2007/0093945 | A1* | 4/2007 | Grzywna | G05D 1/101 701/23 |
| 2010/0227527 | A1 | 9/2010 | Smoot | |
| 2014/0024999 | A1* | 1/2014 | Levien | G05D 1/00 604/66 |
| 2014/0231590 | A1 | 8/2014 | Trowbridge et al. | |
| 2014/0236388 | A1* | 8/2014 | Wong | B64C 39/024 701/2 |
| 2014/0249693 | A1* | 9/2014 | Stark | B64C 39/024 701/2 |
| 2014/0263823 | A1* | 9/2014 | Wang | B64C 39/028 244/17.23 |
| 2015/0041596 | A1* | 2/2015 | Markov | B64D 1/16 244/190 |
| 2015/0181819 | A1* | 7/2015 | Celebi | B64C 39/024 701/2 |
| 2016/0059145 | A1* | 3/2016 | Cortelyou | A63H 27/12 472/57 |

FOREIGN PATENT DOCUMENTS

| | | |
|---|---|---|
| WO | 2013002778 | 1/2013 |
| WO | 2014077524 | 5/2014 |

* cited by examiner

AIR DELIVERED SPECIAL EFFECTS

BACKGROUND

1. Field

This disclosure generally relates to the field of special effects. More particularly, the disclosure relates to delivery methods for special effects.

2. General Background

Various special effects are often used in entertainment environments, e.g., theme park features, to provide an added level of excitement to an entertainment experience. Examples of special effects are pyrotechnics, water features, features with other types of liquid, confetti, interactive features, etc. Although some special effect features are controlled and delivered at a ground position, other special effect features are delivered from ground to air. As an example, a pyrotechnic feature such as a firework shell is discharged from ground to air to follow a particular trajectory, e.g., a parabolic trajectory. That configuration is referred to as a ground delivered special effect configuration. The ground delivered pyrotechnics are typically ignited manually or electronically. After the pyrotechnics have been present in the air for a certain amount of time, a fuse is triggered to ignite the pyrotechnics.

Further, typical aerial fireworks launching systems have limited accuracy. An example is discharging the pyrotechnic to a specific altitude that may not be reached. As a result, a pyrotechnic feature may possibly be ignited at a lower or higher altitude than desired.

Therefore, typical aerial firework launch systems take up a significant area such that fewer audience members can be included in a show and audience members are positioned at location that may limit sight lines and the like in a way that limits the excitement of the audience members. A special effect delivery configuration is needed to deliver special effects in a manner that is safe for audience members of an entertainment experience, but also close enough to provide great sight lines and excitement for audience members.

SUMMARY

A discharge platform comprises a flight mechanism that propels the discharge platform through the air. The discharge platform also comprises a storage apparatus that stores a special effect device such as pyrotechnic, confetti, smoke charge, and the like discharge platform. Further, the discharge platform comprises a processor. In addition, the discharge platform comprises a discharge mechanism that discharges a special effect producing device from the special effect storage apparatus toward a destination after receiving an instruction from the processor discharge platform while the discharge platform is flying so that the special effect producing device is activated to provide an entertainment feature to an audience that is in proximity to the destination. The special effect device can be a pyrotechnic, liquid, confetti, etc.

A process propels a discharge platform through the air. In addition, the process discharges the special effect producing device toward a destination after receiving an instruction while the discharge platform is flying such that the special effect producing device is activated within a proximity to the destination to provide an entertainment feature for an audience at the destination.

A system comprises a transceiver. The system also comprises a discharge platform that stores a special effect producing device and receives an instruction from the transceiver to discharge the special effect producing device toward a destination based upon the instruction while the discharge platform is flying such that the special effect producing device is activated within a proximity to the destination to provide an entertainment feature for an audience at the destination.

BRIEF DESCRIPTION OF THE DRAWINGS

The above-mentioned features of the present disclosure will become more apparent with reference to the following description taken in conjunction with the accompanying drawings wherein like reference numerals denote like elements and in which.

DETAILED DESCRIPTION

An air delivered special effect configuration is provided to deliver special effects from a specific position, e.g., a position identified by specific latitude, longitude, altitude, bearing, etc., in the air to a position in the air or on the ground. A flying vehicle such as a flying robot, drone, airplane, helicopter, balloon etc. is used to deliver the special effect devices, e.g., pyrotechnics, water features, features with other types of liquid, confetti, artificial snow, etc., while in the air. The special effect devices are mounted to the air delivery vehicle and are discharged from a controllable aerial position to the intended position.

The flying vehicle is powered and so can move in a variety of controlled trajectories rather than being constrained to a gravity-defined parabolic trajectory. The flying vehicle discharges the special effect device directly toward the intended position in the air or on the ground. Such a direct discharge is more accurate and precise than a gravity-constrained parabolic discharge that may not reach the intended position.

Figure 1:
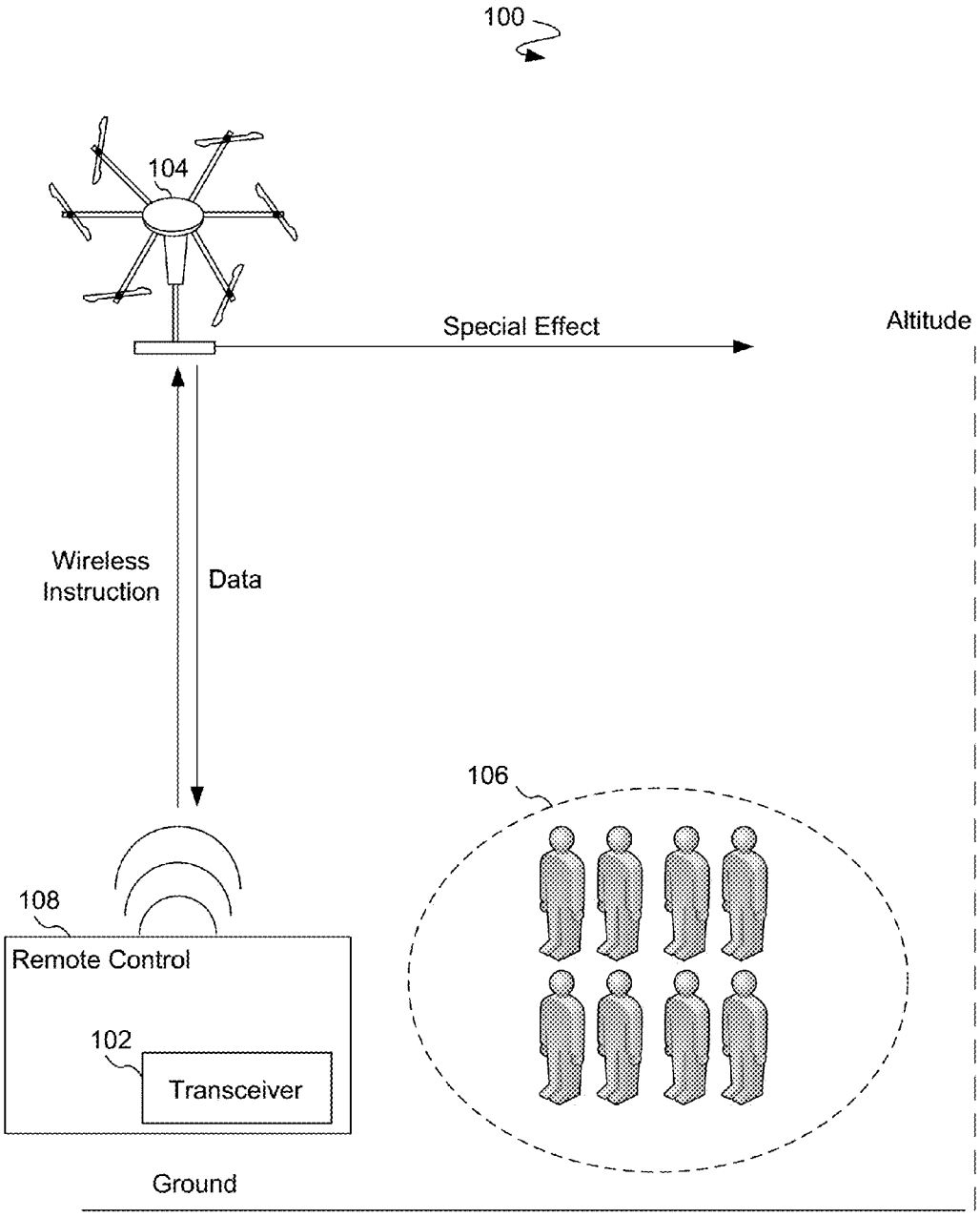
FIG. 1 illustrates an air delivery special effect system.

FIG. 1 illustrates an air delivery special effect system 100. The air delivery special effect system 100 comprises a remote control 108 having a transceiver 102 and a flying discharge platform 104, e.g., drone, airplane, helicopter, or other flying or floating vehicle. The discharge platform 104 flies autonomously or with remote human navigation to a particular altitude above the ground. One or a plurality of audience members 106 are positioned on the ground so that they can view the aerial display. While the discharge platform 104 is positioned at the intended position, e.g., altitude, latitude, longitude, bearing, etc., as determined by onboard sensors, e.g., altimeter, GPS device, etc., the transceiver 102 sends a wireless instruction via a wireless communication protocol, e.g., radio frequency ("RF"), infrared ("IR"), etc., to the discharge platform 104 to discharge a special effect that is operably attached to the discharge platform 104. As an example, the discharge platform 104 discharges a special effect device to a location near or above the plurality of audience members 106. The discharge platform 104 can discharge the special effect in a variety of other directions such as above, below, or to the side of the discharge platform 104. As an example, the discharge platform 104 is positioned at an altitude above the plurality of audience members 106 and at a safe ground distance from the plurality of audience members 106. The discharge platform 104 then triggers pyrotechnics that fall below the discharge platform 104 at a safe ground distance from the plurality of audience members 106. As another example, the discharge platform 104 is positioned directly above the plurality of audience members 106 and discharges confetti or a liquid special effect that safely reaches the plurality of audience members 106.

The remote control 108 is wireless and can be operated manually by a human operator or automatically via a computing device. In one implementation, the human operator or the computing device monitors the position of the discharge platform 104 and sends the wireless instruction when the discharge platform 104 is at the intended location for discharging the special effect. In another implementation, the human operator or the computing device sends a wireless instruction that comprises location data, e.g., GPS coordinates, for discharge activation without the human operator having to monitor the position of the discharge platform 104. The discharge platform 104 receives the wireless instruction and waits until the location provided by the GPS coordinates is reached as determined by an onboard GPS sensor and then discharges the special effect device. For instance, the human operator or the computing device can send a list of GPS coordinates for various locations. The discharge platform 104 then travels to each of the locations provided by the GPS coordinates and discharges a special effect at each of those locations.

In one implementation, the transceiver 102 can also be used to receive data from the discharge platform 104. For instance, the discharge platform 104 can send current GPS coordinates to the transceiver 102 so that the transceiver 102 can obtain location tracking data for the discharge platform 104. Therefore, bidirectional communication between the transceiver 102 and the discharge platform 104 may be used to coordinate delivery of the special effects. In another implementation, a unidirectional transmitter is used instead of the transceiver 102 to provide instructions to the discharge platform 104.

Although the transceiver 102 is illustrated as providing the wireless instruction to the discharge platform 104, a timer can be used instead or in addition. In one implementation, the timer is positioned on the discharge platform 104 to activate a special effect at a synchronized time. In another implementation, the timer is synchronized according to GPS coordinates. Therefore, the discharge platform 104 activates the special effect when the discharge platform 104 reaches predetermined GPS coordinates.

Figure 2:
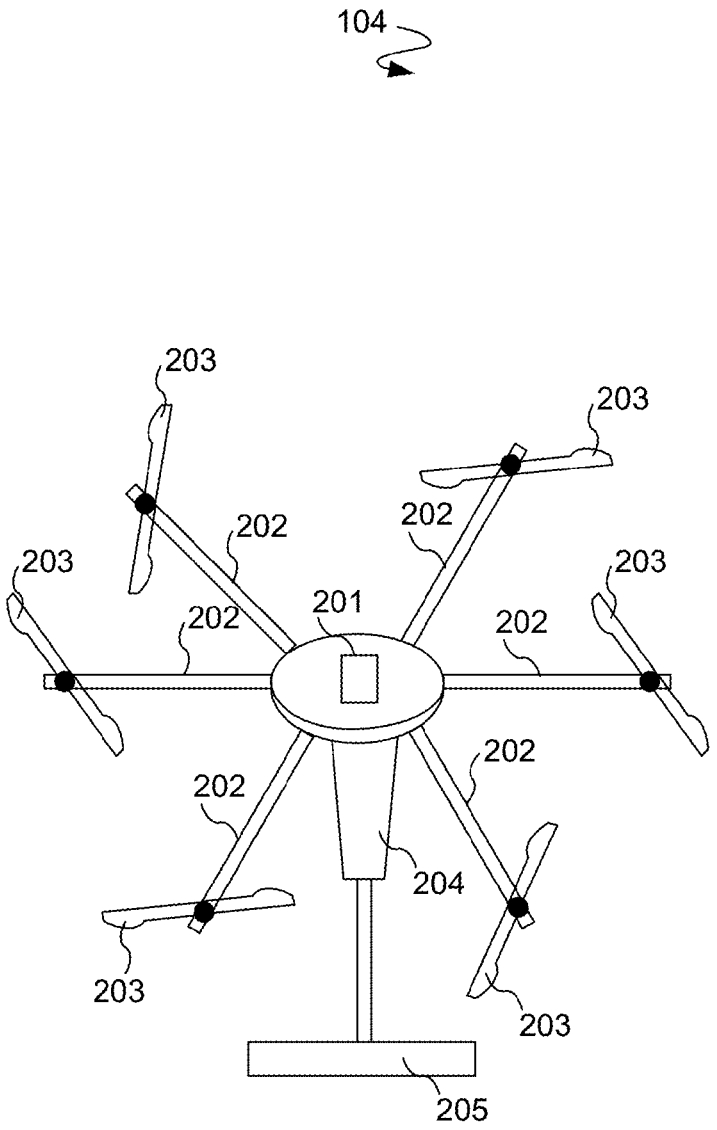
FIG. 2 illustrates the components of the discharge platform.

FIG. 2 illustrates the components of the discharge platform 104. The discharge platform 104 has an electronic control device 201 that receives instructions from the transceiver 102 illustrated in FIG. 1, determines location, and generates discharge instructions. The discharge platform 104 has a plurality of arms 202 that are each operably connected to a propulsion mechanism 203, e.g., a propeller. The discharge platform 104 also has a special effect storage device 204 that stores the special effect devices, e.g., pyrotechnics, that are discharged from a discharge mechanism 205, e.g., a fuse activated discharger, a dispenser that dispenses a special effect, etc. The discharge platform 104 is an unmanned aerial vehicle ("UAV") that is operated remotely or autonomously without a human operator present on the vehicle. The discharge platform 104 is illustrated as a multi-copter, but other flying mechanisms can be used such as an airplane, a helicopter, etc., balloons, can be used.

Figure 3:
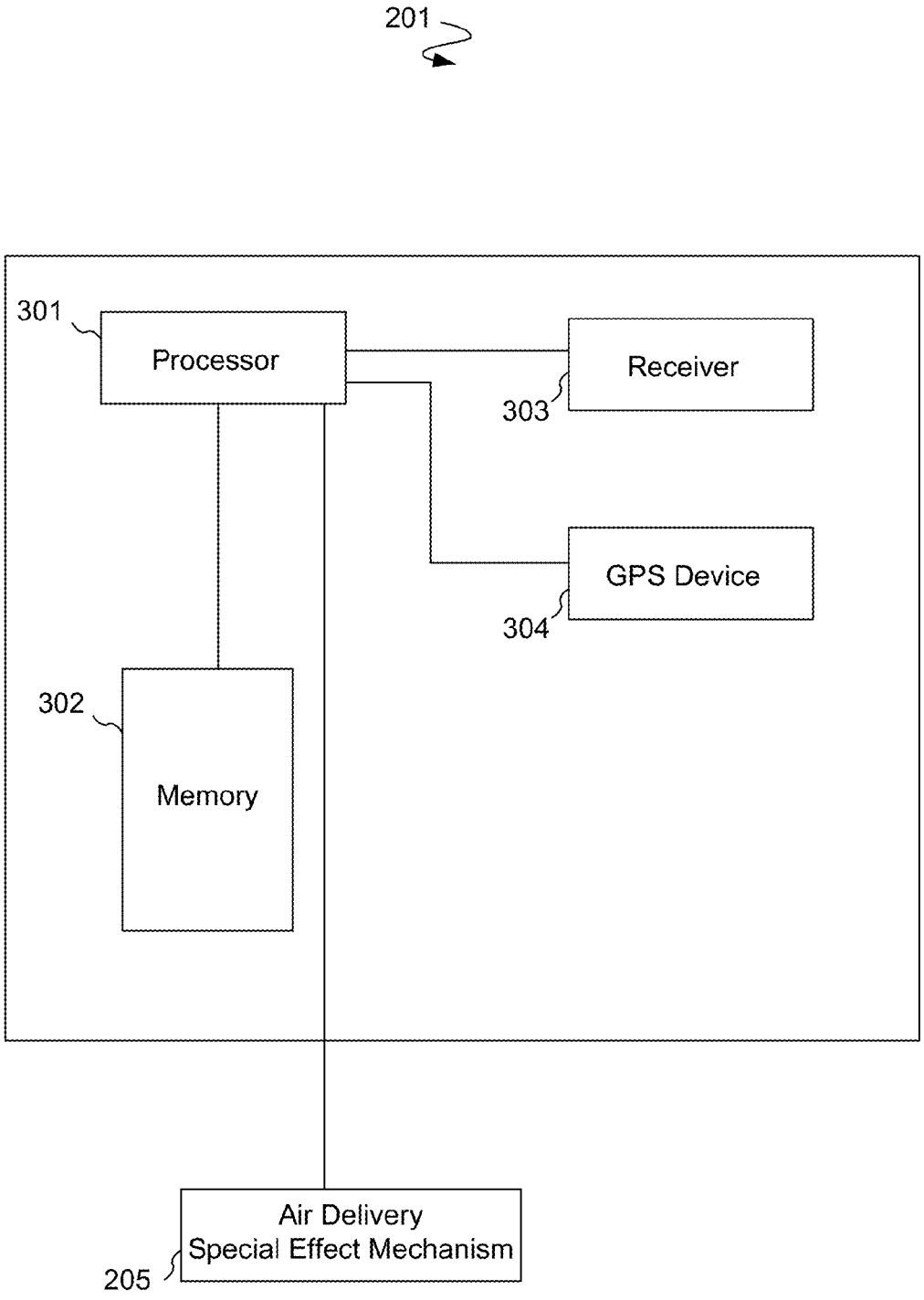
FIG. 3 illustrates the internal electronic components of the electronic control device illustrated in FIG. 2.

FIG. 3 illustrates the internal electronic components of the electronic control device 201 illustrated in FIG. 2. The electronic control device 201 comprises a processor 301, a memory 302, a receiver 303, and a GPS device 304. The receiver 303 receives instructions from the transceiver 102 illustrated in FIG. 1. The receiver 303 provides received instructions to the processor 301. In the implementation in which the instruction comprises GPS coordinates at which the discharge platform 104 is supposed to discharge the special effect, the processor 301 also obtains real time GPS coordinates from the GPS device 304. The processor 301 stores the received data in the memory 302. After determining that the GPS coordinates received from the receiver 303 match or match within a predetermined tolerance level, e.g., ten feet, the processor 301 sends a discharge instruction to the discharge mechanism 205 to discharge the special effect. As an example, the discharge mechanism 205 is an electronic ignition source that ignites a pyrotechnic feature based upon receiving a discharge instruction from the processor 301. Although a GPS device 304 is illustrated in FIG. 3, other types of location data gathering devices can be used instead.

The special effect producing device can be delivered at various altitudes rather than a fixed altitude. For instance, an autonomous discharge platform 104 can fly to different GPS coordinates as well as different altitudes. As a result, the discharge platform can provide a more interesting display of special effects than would be provided at a fixed altitude.

The discharge platform 104 can also be used to provide feedback to humans or computing devices remotely situated from the discharge platform 104. For example, the discharge platform 104 can provide GPS coordinates and corresponding times so that a monitoring system can track the discharge platform 104. The monitoring system can then inform an operator and/or the audience 106 of when the special effect will be delivered. As another example, the discharge platform 104 provides data about the delivery of the special effects, e.g., whether or not the special effects were successfully discharged.

It is understood that the apparatuses, systems, computer program products, and processes described herein may also be applied in other types of apparatuses, systems, computer program products, and processes. Those skilled in the art will appreciate that the various adaptations and modifications of the aspects of the apparatuses, systems, computer program products, and processes described herein may be configured without departing from the scope and spirit of the present apparatuses, systems, computer program products, and processes. Therefore, it is to be understood that, within the scope of the appended claims, the present apparatuses, systems, computer program products, and processes may be practiced other than as specifically described herein.

We claim:

1. A special effect multi-copter comprising:

a discharge platform;

a propulsion mechanism coupled to the discharge platform that propels the discharge platform through the air to a aerial position and maintains the aerial position;

a storage apparatus that stores a special effect producing device and is coupled to the discharge platform; and a dispenser that drops the special effect producing device from the storage apparatus at the aerial position toward a destination after receiving an instruction while the discharge platform is flying such that the special effect producing device is activated to provide a special effect for a human audience at a predetermined distance from the destination.

2. The special effect multi-copter of claim 1, further comprising a receiver that receives an instruction from a remote transmission device to drop the special effect producing device.

3. The special effect multi-copter of claim 1, wherein the instruction comprises GPS coordinates for the aerial position.

4. The special effect multi-copter of claim 1, further comprising a GPS sensor that determines GPS coordinates for a position of the discharge platform.

5. A method comprising:

propelling a discharge platform through the air to a aerial position, the discharge platform storing a special effect producing device;

maintaining the aerial position;

receiving an instruction while the discharge platform is flying, the instruction providing a destination for a special effect;

activating a dispenser that dispenses a special effect producing device based upon the instruction;

dispensing the special effect producing device at the aerial position toward the destination based upon the activation of the dispenser to provide an entertainment feature for a human audience at a predetermined distance from the destination.

6. The method of claim 5, further comprising receiving an instruction from a remote transmission device to discharge the special effect producing device.

7. The method of claim 5, further comprising receiving GPS coordinates for the aerial position.

8. The method of claim 7, further comprising propelling the discharge platform through the air to the GPS coordinates.

9. The method of claim 5, further comprising activating the dispenser manually via a remote control or automatically via a timer.

10. The method of claim 5, wherein the discharge platform is propelled autonomously through the air without human intervention.

11. A multi-copter system comprising:

a transceiver;

a discharge platform that stores a special effect producing device and receives an instruction from the transceiver to activate a dispenser that drops a special effect producing device from a aerial position toward a destination based upon the instruction while the discharge platform is flying to provide a special effect for an audience at a predetermined distance from the destination.

12. The multi-copter system of claim 11, wherein the instruction comprises GPS coordinates for the aerial position.

13. The multi-copter system of claim 11, wherein the discharge platform is propelled autonomously.

* * * * *